US011270657B2

(12) United States Patent
Zhao et al.

(10) Patent No.: US 11,270,657 B2
(45) Date of Patent: Mar. 8, 2022

(54) DRIVING METHOD, DRIVING APPARATUS, DISPLAY DEVICE AND COMPUTER READABLE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Chenxi Zhao, Beijing (CN); Hao Zhang, Beijing (CN); Lili Chen, Beijing (CN); Minglei Chu, Beijing (CN); Xiangjun Peng, Beijing (CN); Yachong Xue, Beijing (CN); Gang Li, Beijing (CN); Shuo Zhang, Beijing (CN); Yaoyu Lv, Beijing (CN); Mingyang Yan, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/982,550

(22) PCT Filed: Apr. 13, 2020

(86) PCT No.: PCT/CN2020/084449

§ 371 (c)(1),
(2) Date: Sep. 19, 2020

(87) PCT Pub. No.: WO2020/224387

PCT Pub. Date: Nov. 12, 2020

(65) Prior Publication Data

US 2021/0158766 A1 May 27, 2021

(30) Foreign Application Priority Data

May 6, 2019 (CN) ..... 201910373666.4

(51) Int. Cl.
*G09G 3/34* (2006.01)
*G09G 3/36* (2006.01)

(52) U.S. Cl.
CPC ..... *G09G 3/3426* (2013.01); *G09G 3/3607* (2013.01); *G09G 2320/0247* (2013.01);
(Continued)

(58) Field of Classification Search
CPC ..... G09G 2320/0646; G09G 2360/16; G09G 2320/0653; G09G 2320/066; G09G 3/3406; G09G 3/3413; G09G 3/342; G09G 3/3426; G09G 2320/062; G09G 2320/0633
See application file for complete search history.

(56) References Cited

U.S. PATENT DOCUMENTS 10,878,762 B2 12/2020 Shi et al.
2008/0007186 A1 1/2008 Lu et al.
(Continued)

FOREIGN PATENT DOCUMENTS

CN 101546532 A 9/2009
CN 101622657 A 1/2010
(Continued)

OTHER PUBLICATIONS

First Chinese Office Action dated Apr. 9, 2020, received for corresponding Chinese Application No. 201910373666.4, 22 pages.

*Primary Examiner* — Dennis P Joseph
(74) *Attorney, Agent, or Firm* — Kinney & Lange, P.A.

(57) ABSTRACT

The present disclosure provides a method for driving a display device, an apparatus for driving a display device, a display device and a computer readable medium. The display device includes a backlight module, and the backlight module includes a plurality of backlight partitions. The
(Continued)

driving method may include: determining backlight signal values of the plurality of backlight partitions according to input grayscale values of pixels in an image to be displayed; determining a backlight jump value of each of the plurality of backlight partitions according to the backlight signal values of the plurality of backlight partition; adjusting the backlight signal values of the plurality of backlight partitions according to the backlight jump values to obtain adjusted backlight signal values; and driving the backlight module to emit light using the adjusted backlight signal values of the plurality of backlight partitions.

12 Claims, 8 Drawing Sheets

(52) U.S. Cl.
CPC ..... *G09G 2320/066* (2013.01); *G09G 2320/0646* (2013.01); *G09G 2360/16* (2013.01)

(56) References Cited

U.S. PATENT DOCUMENTS

| | | | | |
|---|---|---|---|---|
| 2010/0013872 | A1 | 1/2010 | Masuda et al. | |
| 2017/0110065 | A1* | 4/2017 | Zhang | G09G 3/2018 |
| 2019/0086724 | A1* | 3/2019 | Shih | G02F 1/133602 |
| 2019/0348001 | A1 | 11/2019 | Shi et al. | |

FOREIGN PATENT DOCUMENTS

| | | | |
|---|---|---|---|
| CN | 101777312 | A | 7/2010 |
| CN | 101996586 | A | 3/2011 |
| CN | 105047145 | A | 11/2015 |
| CN | 105869579 | A | 8/2016 |
| CN | 107845369 | A | 3/2018 |
| CN | 108428436 | A | 8/2018 |
| CN | 108470548 | A | 8/2018 |
| CN | 108806620 | A | 11/2018 |
| CN | 109243384 | A | 1/2019 |
| CN | 109979401 | A | 7/2019 |

* cited by examiner

DRIVING METHOD, DRIVING APPARATUS, DISPLAY DEVICE AND COMPUTER READABLE MEDIUM

CROSS-REFERENCE TO RELATED APPLICATION(S)

This application is the national phase of PCT application PCT/CN2020/084449 filed on Apr. 13, 2020, which in turn claims priority to Chinese Patent Application No. 201910373666.4, filed on May 6, 2019, which is incorporated herein by reference in its entirety.

TECHNICAL FIELD

The present disclosure relates to the field of display technology, and more particularly, to a method for driving a display device, an apparatus for driving a display device, a display device, and a non-transitory computer-readable storage medium.

BACKGROUND

A display device such as a liquid crystal display etc. may be controlled using a local backlight adjustment (Local Dimming) method, so as to reduce power consumption of the display device, increase a contrast of a display image, and reduce afterimages, etc. This local backlight adjustment method is to divide a backlight source of the display device into a plurality of backlight partitions, and then control the respective backlight partitions independently.

However, in the implementation process, the display image appears bright blocks or flickers due to the backlight change of the liquid crystal display panel (LCD), which affects the display effect.

SUMMARY

The present disclosure provides a method for driving a display device, an apparatus for driving a display device, a display device and a non-transitory computer-readable storage medium.

According to an aspect of the present disclosure, there is provided a method for driving a display device comprising a backlight module, the backlight module comprises a plurality of backlight partitions, and the method comprising: determining backlight signal values of the plurality of backlight partitions according to input grayscale values of pixels in an image to be displayed; determining a backlight jump value of each of the plurality of backlight partitions according to the backlight signal values of the plurality of backlight partition; adjusting the backlight signal values of the plurality of backlight partitions according to the backlight jump values to obtain adjusted backlight signal values; and driving the backlight module to emit light using the adjusted backlight signal values; wherein determining a backlight jump value of each of the plurality of backlight partitions according to the backlight signal values of the plurality of backlight partition comprises: acquiring a calculation model by fitting according to the backlight signal value of the backlight partition, backlight interference value of a plurality of adjacent backlight partitions of the backlight partition, and an average value of input pixel values of each color component in a sub-display area corresponding to the backlight partition; and calculating the backlight jump value of the backlight partition using the calculation model.

In an example, the calculation model is expressed as:

$$L_{STEP}=a_1+a_2\times L_m+a_3\times L_m^2+a_4\times L_m^3+a_5\times L_{ROUND}+a_6\times L_{ROUND}^2+a_7\times L_{ROUND}^3+a_8\times L_m\times L_{ROUND}+a_9\times R_{avg}+a_{10}\times R_{avg}^2+a_{11}\times R_{avg}^3+a_{12}\times G_{avg}+a_{13}\times G_{avg}^2+a_{14}\times G_{avg}^3+a_{15}\times B_{avg}+a_{16}\times B_{avg}^2+a_{17}\times B_{avg}^3,$$

wherein $L_{STEP}$ is the backlight jump value of the backlight partition, $L_m$ is the backlight signal value of the backlight partition, $L_{ROUND}$ is the backlight interference value of the plurality of adjacent backlight partitions of the backlight partition, and $R_{avg}$ is an average value of input pixel values of a red color component in the sub-display area corresponding to the backlight partition, $G_{avg}$ is an average value of input pixel values of a green color component in the sub-display area corresponding to the backlight partition, and $B_{avg}$ is an average value of input pixel values of a blue color component in the sub-display area corresponding to the backlight partition, $a_1$ to $a_{17}$ are coefficients of the calculation model obtained by performing fitting using the calculation model.

In an example, the adjusting the backlight signal values of the plurality of backlight partitions according to the backlight jump values comprises: for each of the plurality of backlight partitions: acquiring a maximum value of the backlight signal values of at least one adjacent backlight partition of the backlight partition; comparing a difference value between the maximum value and the backlight signal value with the backlight jump value; if the difference value between the maximum value and the backlight signal value of the backlight partition is greater than the backlight jump value, then the adjusted backlight signal value of the backlight partition is equal to an difference value between the maximum value and the backlight jump value; and if the difference value between the maximum value and the backlight signal value of the backlight partition is less than or equal to the backlight jump value, then the adjusted backlight signal value of the backlight partition is equal to the backlight signal value of the backlight partition.

In an example, the display device further comprises a display panel, and the method further comprises: compensating the input grayscale value of a pixel in the corresponding sub-display area by using the adjusted backlight signal value to obtain a compensated input grayscale value; comparing the compensated input grayscale value with statistical information of the input grayscale value of the pixel in the corresponding sub-display area, and determining an output grayscale value of the pixel according to a comparison result; and driving the display panel for display by using the determined output grayscale value of the pixel.

In an example, the comparing the compensated input grayscale value with statistical information of the input grayscale value of the pixel in the corresponding sub-display area, and determining an output grayscale value of the pixel according to a comparison result comprises: acquiring a maximum color component value of the compensated input grayscale value; comparing the maximum color component value with the statistical information; determining that the compensated input grayscale value is the output grayscale value of the pixel, in response to the maximum color component value is greater than the statistical information; and determining the output grayscale value of the pixel according to the maximum color component value, the statistical information, the compensated input grayscale value, and an input grayscale value processed by a predetermined algorithm, in response to the maximum color component value is less than or equal to the statistical information.

In an example, if the maximum color component value is less than or equal to the statistical information, the output grayscale value $V_{output_p}$ of the pixel p is determined according to the following equation:

$$V_{output_p} = \frac{(S_m - V_{p_max}) \times V_{hazeremove_p}}{255} + \frac{V_{p_max} \times V_{compen_p}}{255}$$

wherein $V_{p_max}$ is the maximum color component value, $S_m$ is the statistical information, $V_{compen_p}$ is the compensated input grayscale value, and $V_{hazeremove_p}$ is the input grayscale value processed by the predetermined algorithm.

In an example, the predetermined algorithm comprises a Haze Removal.

In an example, the determining backlight signal values of the plurality of backlight partitions in the backlight module comprises: for each of the plurality of backlight partitions, calculating an average value of the input grayscale values of pixels and a cumulative distribution function value in the sub-display area corresponding to the backlight partition; and determining the backlight signal value of the backlight partition according to the average value and the cumulative distribution function value.

In an example, the determining the backlight signal value of the backlight partition according to the average value and the cumulative distribution function value comprises determining the backlight signal value $L_m$ of the backlight partition by using the following equation:

$$\left\{ L_m = L_{avg} + k \times \left( L_{dif} + \frac{L_{dif}^2}{255} \right) \right.$$

wherein $L_{avg}$ is an average value of the input grayscale values in the sub-display area corresponding to the backlight partition, $L_{dif}=L_{cdf}-L_{avg}$, $L_{cdf}$ is a cumulative distribution function value of the input grayscale value of the pixel in the corresponding sub-display area, $$k = 0.5 - \frac{L_{dif}}{255} * 0.5.$$

According to another aspect of the present disclosure, there is provided an apparatus for driving a display device, the display device comprises a backlight module comprising a plurality of backlight partitions, and the apparatus comprises: a first determination module configured to determine backlight signal values of a plurality of backlight partitions according to input grayscale values of pixels in an image to be displayed; a second determination module configured to determine a backlight jump value of each of the plurality of backlight partitions according to the backlight signal values of the plurality of backlight partitions; an adjustment module configured to adjust the backlight signal values of the plurality of backlight partitions according to the backlight jump values to obtain adjusted backlight signal values; and a first driving module configured to drive the backlight module to emit light by using the adjusted backlight signal values; wherein the second determination module is further configured to: acquire a calculation model by fitting according to the backlight signal values of the backlight partitions, the backlight interference values of the plurality of adjacent backlight partitions of the backlight partition, and an average value of input pixel values of each color component in a sub-display area corresponding to the backlight partition; and calculate the backlight jump values of the backlight partitions by using the calculation model.

In an example, the display device further comprises a display panel, and the apparatus further comprises: a third determination module configured to acquire a maximum color component value of a compensated input grayscale value; compare the maximum color component value with statistical information; determine that the compensated input grayscale value is an output grayscale value of a pixel, in response to the maximum color component value is greater than the statistical information; and determine the output grayscale value of the pixel according to the maximum color component value, the statistical information, the compensated input grayscale value, and an input gray scale value processed by a predetermined algorithm, in response to the maximum color component value is less than or equal to the statistical information; and a second driving module configured to drive the display panel for display by using the determined output grayscale value of the pixel.

According to another aspect of the present disclosure, there is provided a driving apparatus, comprising: a memory configured to store instructions; at least one processor which executes the instructions stored in the memory to implement the method according to embodiments of the present disclosure.

According to another aspect of the present disclosure, there is provided a display device, comprising: a display panel comprising a plurality of sub-display areas; a backlight module comprising a plurality of backlight partitions; and the driving apparatus according to embodiments of the present disclosure.

According to another aspect of the present disclosure, there is provided a non-transitory computer-readable storage medium having stored thereon instructions that are configured to, when executed by at least one processor, implement the method according to embodiments of the present disclosure.

BRIEF DESCRIPTION OF THE DRAWINGS

The above and other purposes, features, and advantages of the embodiments of the present disclosure will become more apparent through the following description of the embodiments of the present disclosure with reference to the accompanying drawings. It should be illustrated that throughout the accompanying drawings, the same elements are represented by the same or similar reference signs. In the accompanying drawings.

DETAILED DESCRIPTION OF EMBODIMENTS

Figure 1A:
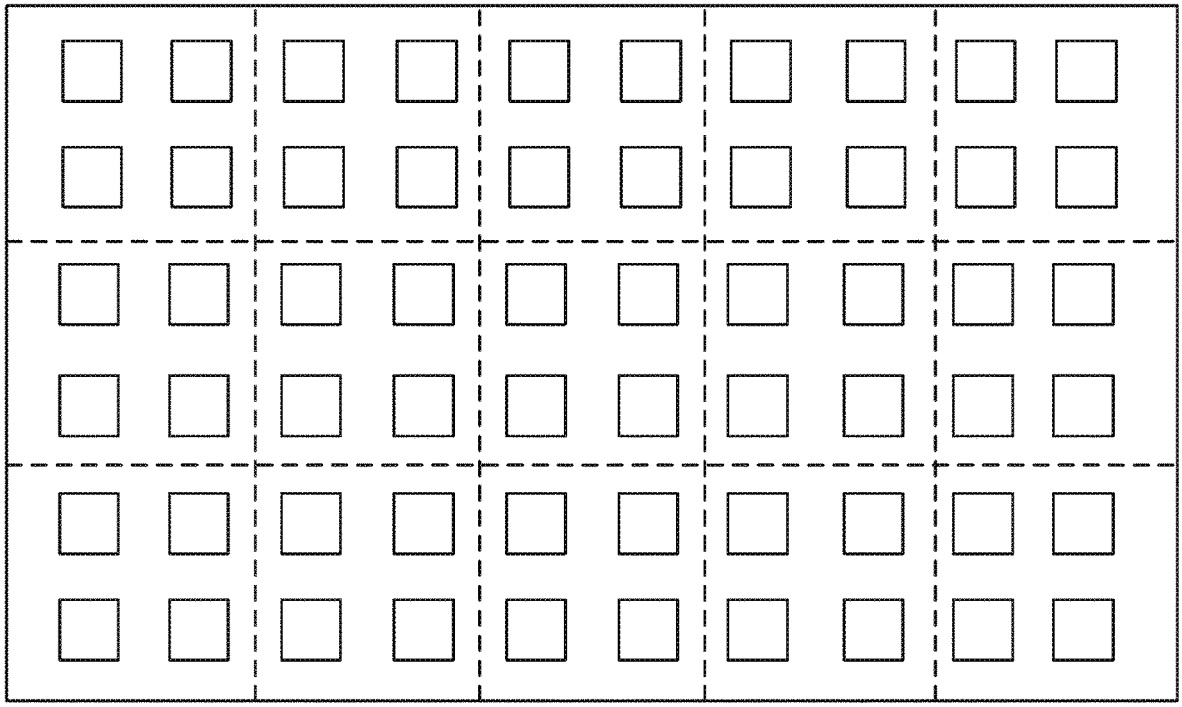
FIG. 1A shows a schematic diagram of divided backlight partitions of an LED light source backlight module.

In order to make the purposes, technical solutions and advantages of the embodiments of the present disclosure more clear, the technical solutions in the embodiments of the present disclosure will be clearly and completely described below in conjunction with the accompanying drawings in the embodiments of the present disclosure. Obviously, the embodiments described are a part of the embodiments of the present disclosure instead of all the embodiments. All other embodiments obtained by those of ordinary skill in the art based on the described embodiments of the present disclosure without any creative effort are within the protection scope of the present disclosure. In the following description, some specific embodiments are for illustrative purposes only and are not to be construed as limiting the present disclosure, but merely examples of the embodiments of the present disclosure. The conventional structure or construction will be omitted when it may cause confusion to the understanding of the present disclosure. It should be illustrated that shapes and dimensions of components in the figures do not reflect true sizes and proportions, but only illustrate contents of the embodiments of the present disclosure.

Furthermore, in the description of the embodiments of the present disclosure, the term "connected to" or "connected" may mean that two components are directly connected, or that two components are connected via one or more other components. In addition, the two components can be connected or coupled by wire or wirelessly.

In addition, in the description of the embodiments of the present disclosure, unless otherwise defined, the technical terms or scientific terms used in the present disclosure should be the ordinary meanings understood by those with ordinary skills in the field to which the disclosure belongs. The "first", "second" and similar words used in the present disclosure do not indicate any order, quantity, or importance, but are only used to distinguish different components. Similarly, similar words such as "a", "one" or "the" do not mean quantity limitation, but mean that there is at least one. The "include" or "comprise" and other similar words mean that the element or item appearing before the word covers the elements or parts listed after the word and their equivalents, but does not exclude other elements or parts.

For example, a liquid crystal display device LCD is a passive display device. The LCD may include a display panel and a backlight module. The display panel itself does not emit light, but the backlight module serves as a light source to provide backlight. The backlight module may be controlled by using a local backlight adjustment method, thereby improving the display quality of the display panel. The local backlight adjustment method may not only reduce the power consumption of the display panel, but also realize the dynamic dimming of the backlight module, so as to increase a contrast of the display image and improve the display quality of the display panel.

The local backlight adjustment method substantially divides the backlight module or the backlight source of the display device into a plurality of backlight partitions that may be driven separately, and then independently controls the luminous brightness of the backlight source in the backlight partition for each backlight partition. Each backlight partition may include one or more light emitting diodes (LEDs) as light sources. A driving current of a LED in the corresponding backlight partition is adjusted according to a grayscale value required by an image to be displayed on a display screen, so as to realize the individual adjustment of the brightness of each backlight partition in the backlight module.

FIG. 1A shows a schematic diagram of divided backlight partitions of an LED light source backlight module. As shown in FIG. 1A, each small square in the figure represents an LED unit, and a plurality of regions separated by dotted lines represent a plurality of backlight partitions SB. In the example of FIG. 1A, each backlight partition may include four LED units, and each backlight partition may be controlled by the four LED units independently of each other. For example, the LEDs in each backlight partition are linked, that is, the current applied to the LEDs in the same backlight partition is the same.

Figure 1B:
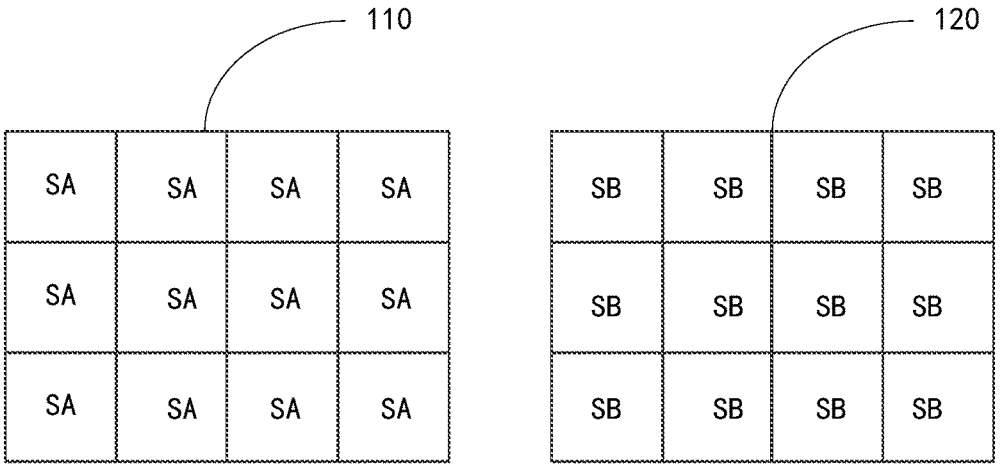
FIG. 1B shows a schematic diagram of a display panel and a backlight module in a display device.

FIG. 1B shows a schematic diagram of a display panel and a backlight module in a display device. As shown in FIG. 1B, the display area of the display panel 110 may be divided into a plurality of sub-display areas SA corresponding to a plurality of backlight partitions SB, respectively. Those skilled in the art may understand that the position of the sub-display area $SA_m$ corresponds to the position of the backlight partition $SB_m$, and has the same size as that of the backlight partition $SB_m$, where $1 \leq m \leq M$, and M is the number of backlight partitions in the backlight module. The number of sub-display areas SA is the same as the number of backlight partitions SB. The inventor of the present disclosure realized that the visual brightness of a certain sub-display area SA mainly depends on the light transmittance of the sub-display area SA and the brightness of the backlight partition SB corresponding to the sub-display area SA. While the light transmittance of a certain sub-display area SA depends on a deflection angle of the light valve, such as liquid crystal molecules, which is affected by the applied electric field, and the deflection angle is directly related to a data signal (i.e., a grayscale value of the pixel in the image to be displayed) provided to the sub-display area. Therefore, it may be considered that the visual brightness of the sub-display area SA is determined by the data signal provided to the sub-display area and the backlight signal value of the backlight partition corresponding to the sub-display area. Therefore, the brightness of the corresponding backlight partition may be adjusted according to the grayscale value of the pixel of the image to be displayed on the display panel. For the areas with higher brightness (grayscale value) on the display screen, the brightness of the corresponding backlight partition is also high, and for the areas with lower brightness on the display screen, the brightness of the corresponding backlight partition is also low, so as to reduce the backlight power consumption, increase a contrast of the display image, and improve the display quality.

However, in a process of displaying images on the display device, the backlight brightness of the backlight partition may change significantly, which is called "backlight jump". These backlight jumps may cause the brightness difference values between the backlight partitions with jumps and the adjacent backlight partitions to be too large, so that the human eyes perceive bright blocks on the display screen. In addition, these backlight jumps may also cause the backlight brightness difference values between adjacent frames to be too large, so as to make the human eyes perceive flickers of the display screen.

In addition, the backlight unit in the backlight module may include a direct type backlight unit or an edge type backlight unit. The direct type backlight unit may include a plurality of point light sources (such as LED light sources) arranged side by side and a diffuser plate. The light emitted by these point light sources is homogenized by the diffuser plate, and then enters the display panel to serve as the backlight of the display panel. The light emitted by the LED light source has a certain diffusion angle, which causes the light emitted by the LED light source of each backlight partition to affect the adjacent backlight partition. After mutual coupling, there is a deviation between the final display brightness of each backlight partition and the ideal value, so that "the bright is not bright enough, and the dark is not dark enough". For example, the light emitted by the LED light source of the backlight partition requiring a brighter display may diffuse to the adjacent relatively dark backlight partition, so that the display brightness of the backlight partition requiring a brighter display may not reach the display brightness actually required by the display screen, and the display brightness of the backlight partition requiring a darker display exceeds the display brightness actually required by the display screen, which leads to a decrease in the contrast of the display screen.

According to an embodiment of the present disclosure, there is provided a method for driving a display device. It may be understood by those skilled in the art that serial numbers of various steps in the following method are only used as representations of the steps for description, and should not be regarded as indicating an execution order of the respective steps. Unless explicitly stated, the steps of the method need not to be performed exactly in the order shown, or some steps may be performed at the same time.

Figure 2:
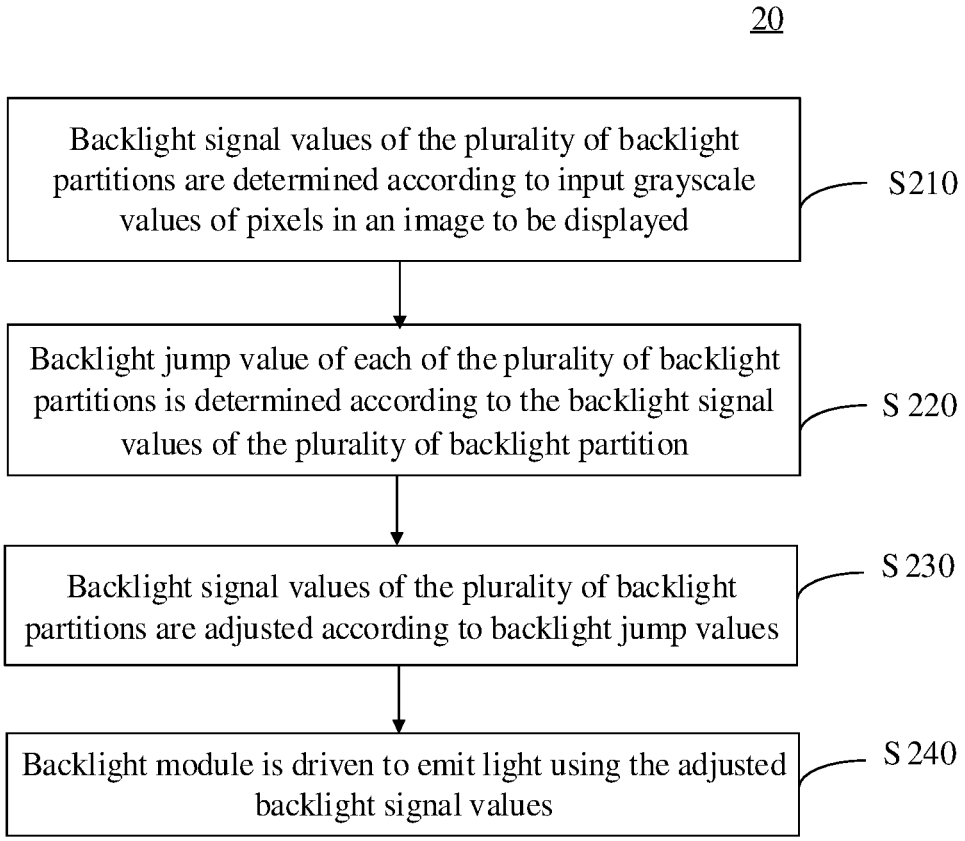
FIG. 2 shows a flowchart of a method for driving a display device according to an embodiment of the present disclosure.

FIG. 2 shows a schematic flowchart of a method 20 for driving a display device according to an embodiment of the present disclosure. For example, the display device may include a backlight module, and the backlight module may include a plurality of the backlight partitions. As shown in FIG. 2, the method 20 for driving the display device according to the embodiment of the present disclosure may include the following steps.

In step S210, backlight signal values of the plurality of backlight partitions are determined according to input grayscale values of pixels in an image to be displayed.

In step S220, a backlight jump value of each of the plurality of backlight partitions is determined according to the backlight signal values of the plurality of backlight partition.

In step S230, the backlight signal values of the plurality of backlight partitions are adjusted according to backlight jump values to obtain the adjusted backlight signal values.

In step S240, the backlight module is driven to emit light using the adjusted backlight signal values.

Where a backlight jump value of each of the plurality of backlight partitions is determined according to the backlight signal values of the plurality of backlight partition may include: a calculation model is acquired by fitting according to the backlight signal values of the backlight partitions, backlight interference values of a plurality of adjacent backlight partitions of the backlight partitions, and an average value of input pixel values of each color component in a sub-display area corresponding to the backlight partition; and the backlight jump values of the backlight partition are calculated using the calculation model.

According to the technical solution of the embodiment of the present disclosure, the statistical information of the input grayscale values of the pixels in the image to be displayed is used to determine the backlight signal value of each backlight partition. The backlight signal value of each backlight partition and the backlight interference values of the plurality of the adjacent backlight partitions are used to fit the calculation model, the calculation model is used to obtain the backlight jump value of each backlight partition, and the backlight signal value of the backlight partition is adjusted according to the backlight jump value, so as to alleviate the bright block or flicker of the display screen caused by the excessive change of the backlight signal value, and improve the display effect. In addition, the technical solution of the embodiment of the present disclosure compensates the input grayscale values of the pixels according to the adjusted backlight signal values and the statistical information of the input grayscale values of the pixels in the sub-display areas. Therefore, the backlight signal value of each backlight partition and the input grayscale values of the pixels may be considered at the same time to display the image, which increases the display contrast and further improves the display effect.

Next, a method 20 for driving according to an embodiment of the present disclosure will be described in detail with reference to the accompanying drawings. According to an embodiment of the present disclosure, the "input grayscale values of pixels" may refer to original grayscale values of pixels of the image to be displayed.

According to an embodiment of the present disclosure, in step S210, among the red R, green G, and blue B color component values of the original grayscale values of pixels, the maximum color component value with the maximum value may be used as the input grayscale value of the pixel. This may avoid clipping in the pixel compensation process in the subsequent processing example. That is, for the pixel (i, j), the input pixel value $gray_{i,j}=\max\{R_{i,j}, G_{i,j}, B_{i,j}\}$, where $R_{i,j}$, $G_{i,j}$, and $B_i$, represent the pixel values of the R, G, and B color components of the pixel (i, j), respectively.

In addition, according to another example, the image to be displayed may also be converted into a spatial domain. For example, the image to be displayed may be an RGB image with a resolution of W×H. The original input image in RGB format may be converted to HSV (Hue, Saturation, and Brightness Value) color space format to separate the hue component, saturation component, and brightness component of the original image, and the brightness component V is used as the input grayscale value of the pixel in subsequent processing, so as to preserve the brightness of the original image as much as possible. That is, for the pixel (i, j), the input pixel value $gray_{i,j}=V_{i,j}$, where i and j are integers greater than or equal to 1, and respectively represent the position of the pixel in the image to be displayed. Those skilled in the art may understand that various methods may be used to perform the RGB-HSV color space conversion, so that the component V obtained by the HSV conversion may be a grayscale value of 0 to 255, which will not be repeated here for brevity.

For each sub-display area $SA_m$, the maximum input grayscale value of the pixel in the sub-display area $SA_m$ may be directly selected as the backlight signal value of the corresponding backlight partition $SB_m$, where $1 \le m \le M$, and M is the number of the backlight partitions in the backlight module. This method may be referred to as "maximum value method". In addition, the average value of the input grayscale values of the pixels in the sub-display area $SA_m$ may also be used as the backlight signal value corresponding to the backlight partition $SB_m$, and this method may be referred to as "average value method."

According to an embodiment of the present disclosure, in step S210, determining the backlight signal values of the plurality of backlight partitions may include: for each of the plurality of backlight partitions, calculating the average value of the input grayscale values of pixels and cumulative distribution function (CDF) value in the sub-display area corresponding to the backlight partition, and determining the backlight signal value of the backlight partition according to the average value and the cumulative distribution function value.

For example, for the sub-display area $SA_m$ corresponding to the backlight partition $SB_m$, the average value of the input grayscale values of pixels in the sub-display area $SA_m$ may be expressed as $L_{avg}$, the CDF value may be expressed as $L_{cdf}$, and the backlight signal value $L_m$ of the backlight partition $SB_m$ may be determined according to the following equation (1).

$$\left\{ L_m = L_{avg} + k \times \left( L_{dif} + \frac{L_{dif}^2}{255} \right) \right. \quad \text{equation (1)}$$

where $$L_{dif} = L_{cdf} - L_{avg}.$$

In an example, the CDF may be taken as 0.95, $L_{cdf}=L_{0.95}$. According to the histogram statistics of the sub-display area $SA_m$, the input grayscale values of 95% of the pixels are lower than the input grayscale value X, $L_{cdf}=L_{0.95}=X$. Those skilled in the art may understand that the value of CDF is theoretically a decimal number close to 1, but less than 1, which is used to exclude the interference of individual tiny high-brightness pixels or areas on the value of $L_m$.

k is the scale factor, in an example, $$k = 0.5 - \frac{L_{dif}}{255} * 0.5.$$

Those skilled in the art may understand that the value of k may also be predetermined according to actual applications, which will not be repeated here.

Those skilled in the art may understand that the backlight signal value obtained by the average value method is more consistent with the image information of the sub-display area, but the overall backlight brightness is too dark, which may cause distortion in the subsequent pixel compensation process. The backlight signal value obtained by the maximum value method is too large and does not match the brightness of the image information of the sub-display area, which may make the contrast of the subsequent compensated display image too low. According to the technical solution of the embodiment of the present disclosure, the overall information ($L_{avg}$) and the image detail information ($L_{cdf}$) of the entire sub-display area image are considered at the same time. Compared with the average value method and the maximum value method, the technical solution according to the embodiments of the present disclosure may obtain a backlight signal value with moderate brightness, and may obtain a display image with better contrast in the subsequent pixel compensation process.

According to an embodiment of the present disclosure, in step S220, determining a backlight jump value of each of the plurality of backlight partitions according to the backlight signal values of the plurality of backlight partition comprises: acquiring a calculation model by fitting according to the backlight signal values of the backlight partitions, backlight interference values of a plurality of adjacent backlight partitions of the backlight partitions, and an average value of input pixel values of each color component in a sub-display area corresponding to the backlight partition; and calculating the backlight jump value of the backlight partition using the calculation model.

The backlight signal value of each backlight partition obtained in step S210 may be adjusted to avoid bright blocks or flickers on the display screen. Those skilled in the art may understand that different people have different sensitivities to changes in light brightness and different color components. For this reason, the technical solutions of the embodiments of the present disclosure use the backlight signal values of the backlight partitions, the backlight interference values of the plurality of adjacent backlight partitions, and the average value of the input pixel values of each color component in the corresponding sub-display area as parameters, the calculation model is acquired by fitting, and the calculation model is used to calculate the backlight jump value $L_{STEP}$ of each backlight partition to simulate the backlight jumps that the human eye may just perceive. Next, a method for calculating the backlight jump value according to an embodiment of the present disclosure will be described in detail.

Figure 3A:
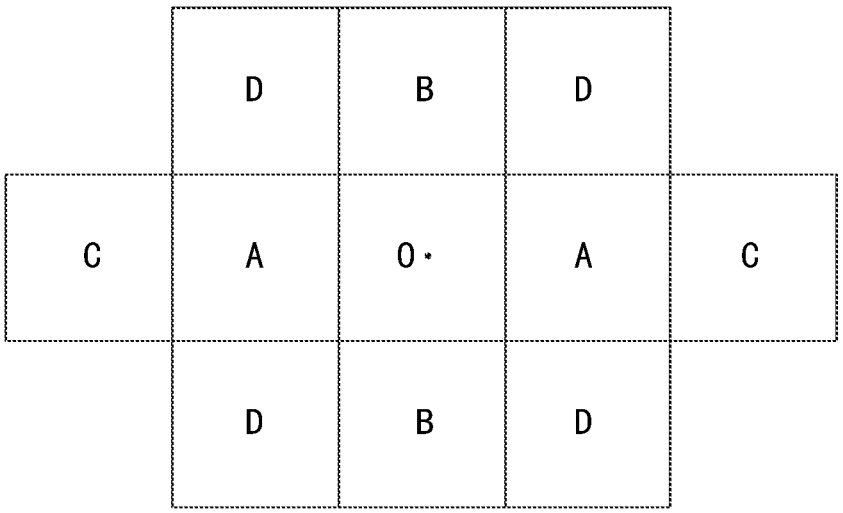
FIG. 3A shows a schematic diagram of a calculation template used for calculating a backlight jump value according to an embodiment of the present disclosure.
Figure 3B:
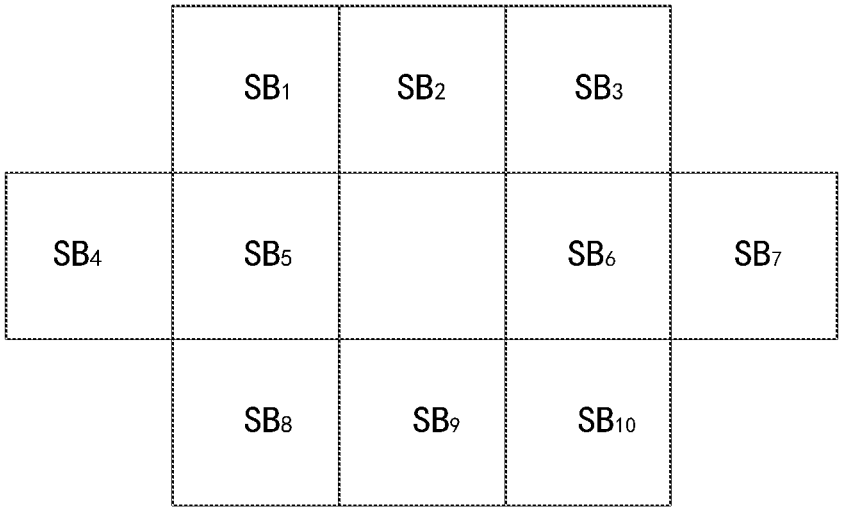
FIG. 3B shows a schematic diagram of adjacent backlight partitions used for calculating a backlight jump value according to an embodiment of the present disclosure.

In an example, for the current backlight partition $SB_m$, the following parameters are considered: 1. the backlight signal value ($L_m$) of the current backlight partition $SB_m$; 2. the backlight interference value ($L_{ROUND}$) of the plurality of adjacent backlight partitions of the current backlight partition $SB_m$; 3. the average value of the red component ($R_{avg}$) of the input pixel value of the sub-display area $SA_m$; 4. the average value of the green component ($G_{avg}$) of the input pixel value of the sub-display area $SA_m$; 5. the average value of the blue component ($B_{avg}$) of the input pixel value of the sub display area $SA_m$.

Where the backlight interference value $L_{ROUND}$ indicates the interference of the backlight signal values of the plurality of adjacent backlight partitions of the current backlight partition on the current backlight partition. Those skilled in the art may understand that a backlight partition may be regarded as a point light source, and the light emitted by the point light source may cause light diffusion and other phenomena. The backlight brightness emitted by the current backlight partition and the plurality of adjacent backlight partitions may affect the backlight diffusion data (actual backlight brightness) of the pixels in the sub-display area corresponding to the current backlight partition. For example, the closer the distance between the pixel and the backlight partition, the greater the influence of the backlight brightness emitted by the backlight partition on the backlight diffusion data of the pixel. The distance between the pixel and the backlight partition is related to the distance between the backlight module and the display panel and the size of the backlight partition. For example, in an example, the backlight interference value $L_{ROUND}$ may be a weighted sum of the backlight signal values of the plurality of adjacent backlight partitions. For example, in the case of considering 10 adjacent backlight partitions, a calculation template as shown in FIG. 3A may be set based on the light diffusion curve of the backlight partition and the size of the backlight partition. FIG. 3B shows a schematic diagram of these 10 adjacent backlight partitions. The interference value $L_{ROUND}$ may be calculated according to the following equation (2) using the weighted sum of the backlight signal values of the 10 adjacent backlight partitions of the current backlight partition.

$$L_{ROUND}=L_1\times D+L_2\times B+L_3\times D+L_4\times C+L_5\times A+L_6\times A+L_7\times C+L_8\times D+L_9\times B+L_{10}\times D \quad \text{equation (2)}$$

Where $L_1$ to $L_{10}$ are the backlight signal values of the backlight partitions $SB_1$ to $SB_{10}$ in FIG. 3B respectively; the template coefficients may be set as A=0.154, B=0.127, C=0.055, D=0.082.

The values of A, B, C, and D in this example are just examples. This value substantially indicates the quantized data corresponding to the central brightness of the adjacent backlight partitions relative to the current backlight partition, where the brightness of the center point O is considered to be 1, and the closer the distance to the center point O, the greater the value, that is, the greater the weight. Of course, those skilled in the art may set other numerical calculation templates, and the embodiments of the present disclosure are not limited thereto.

In addition, those skilled in the art may understand that other numbers of adjacent backlight partitions, for example, 8 adjacent backlight partitions, may be used, and corresponding calculation templates may be set according to the light diffusion curve. The embodiments of the present disclosure are not limited thereto.

In addition, the embodiments of the present disclosure are based on the following biological knowledge: the larger the backlight signal value of the current backlight partition, the lower the sensitivity of human eyes to the backlight changes of the current backlight partition; the larger the backlight signal value of the adjacent backlight partition of the current backlight partition, the greater the brightness of the light diffused to the current backlight partition, the greater the interference to the current backlight partition, and the lower the sensitivity of human eyes to the backlight changes of the current backlight partition; among the three color components of R, G, and B, when the value of the B component in the input grayscale value is the largest, the human eye is most sensitive to the brightness change of the backlight partition, and when the value of the G component in the input grayscale value is the largest, the human eye is moderately sensitive to the brightness change of the backlight partition, and when the value of the R component in the input grayscale value is the largest, the human eye has the lowest sensitivity to the brightness change of the backlight partition; when the values of the three color components are all higher, that is, the closer the display image is to a white image, the higher the sensitivity of human eyes to the brightness change.

Considering the above biological knowledge comprehensively, taking the above five parameters as variables, a five-element cubic equation may be set as a calculation model, which may be expressed as the following equation (3):

$$L_{STEP}=a_1+a_2\times L_m+a_3\times L_m^2+a_4\times L_m^3+a_5\times L_{ROUND}+a_6\times L_{ROUND}^2+a_7\times L_{ROUND}^3+a_8\times L_m\times L_{ROUND}+a_9\times R_{avg}+a_{10}\times R_{avg}^2+a_{11}\times R_{avg}^3+a_{12}\times G_{avg}+a_{13}\times G_{avg}^2+a_{14}\times G_{avg}^3+a_{15}\times B_{avg}+a_{16}\times B_{avg}^2+a_{17}\times B_{avg}^3 \quad \text{equation (3)}$$

Where $L_{STEP}$ is the backlight jump value of the backlight partition, $L_m$ is the backlight signal value of the backlight partition, $L_{ROUND}$ is the backlight interference value of the plurality of adjacent backlight partitions of the backlight partition, and $R_{avg}$ is the average value of the input pixel values of the red component in the sub-display area corresponding to the backlight partition, $G_{avg}$ is the average value of the input pixel values of the green component in the sub-display area corresponding to the backlight partition, and $B_{avg}$ is the average value of the input pixel values of the blue component in the sub-display area corresponding to the backlight partition, $a_1$ to $a_{17}$ are the coefficients of the calculation model acquired by performing fitting using the calculation model.

Next, an example of obtaining the coefficients $a_1$ to $a_{17}$ of the calculation model shown in equation (3) will be described.

First, the following parameters are inputted as samples into the calculation model: the backlight signal value $L_m$ of the current backlight partition $SB_m$, the value range from 0 to 255 is divided evenly into 16 levels, and a representative value is selected in each level as the input sample value; the interference value $L_{ROUND}$ of the plurality of adjacent backlight partitions of the current backlight partition $SB_m$, the value range from 0 to 255 is divided evenly into 16 levels, and a representative value is selected in each level as the input sample value; the average value $R_{avg}$ of the input pixel values of the red component in the sub-display area $SA_m$, and the grayscale value 0, 16, 32, . . . 255 are sequentially selected as the input sample value; the average value ($G_{avg}$) of the input pixel values of the green component in the sub-display area $SA_m$, and the grayscale value 0, 16, 32, . . . 255 are sequentially selected as the input sample value; the average value ($B_{avg}$) of the input pixel values of the blue component in the sub-display area $SA_m$, and the grayscale value 0, 16, 32, . . . 255 are sequentially selected as the input sample value.

The various combinations of the above sample values are used as the input of the calculation model, and the critical value at which the human eye may feel the flicker is used as the output. Those skilled in the art may understand that when the number of input sample points is large enough, the coefficients $a_1$ to $a_{17}$ of the calculation model may be obtained by fitting. The more the number of input sample points, the closer the fitting result is to the ideal value, and the greater the amount of calculation. It may be considered as a compromise between accuracy and calculation amount according to actual applications.

In an example, the following calculation model may be obtained by fitting using the above sample selection method:

$$L_{STEP}=0.81227+0.002149\times L_m+0.002241\times L_m^2-0.00001\times L_m^3+0.04514325\times L_{ROUND}+0.015295335\times L_{ROUND}^2-0.0006\times L_{ROUND}^3+0.005138\times L_m\times L_{ROUND}+0.146149\times R_{avg}-0.01533\times R_{avg}^2+0.000471\times R_{avg}^3+0.028036\times G_{avg}-0.00751\times G_{avg}^2+0.000443\times G_{avg}^3-0.04128\times B_{avg}+0.00144\times B_{avg}^2-0.000066\times B_{avg}^3 \quad \text{equation (4)}$$

Those skilled in the art may understand that the specific values in the above equation (4) are only examples. In practical applications, of course, different coefficients $a_1$ to $a_{17}$ may be obtained by selecting various combinations of input sample values and changing the number of fitting times according to the calculation model described above.

According to the technical solution of the embodiments of the present disclosure, a calculation model is obtained by fitting according to the backlight signal value of each of the backlight partitions, the backlight interference values of the plurality of adjacent backlight partitions, and an average value of input pixel values of each color component in the corresponding sub-display area; and the backlight jump value of the backlight partition is calculated using the calculation model. The backlight jump value indicates the backlight jump magnitude of the backlight signal value of the backlight partition which is just undetectable by human eyes.

Figure 4:
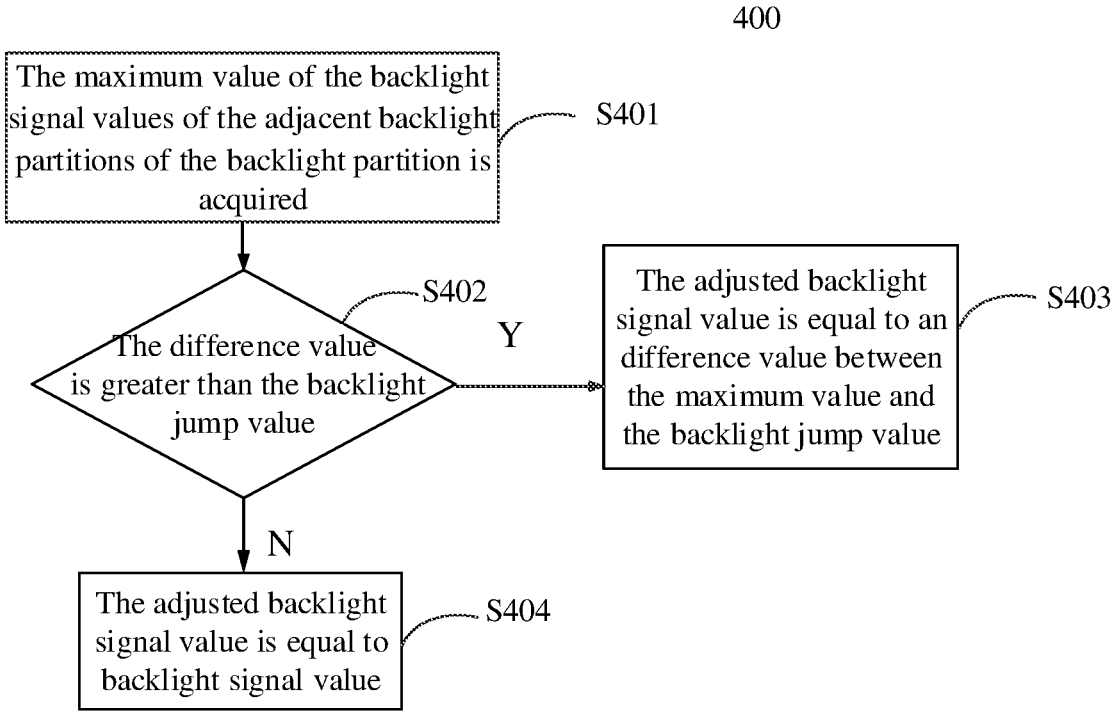
FIG. 4 shows a flowchart of an example method for adjusting the backlight signal value according to the backlight jump value.

Next, in step S230, the backlight signal values of the plurality of backlight partitions are adjusted according to the backlight jump values. FIG. 4 shows a flowchart of an example method 400 for adjusting the backlight signal value according to the backlight jump value. As shown in FIG. 4, an example method 400 according to an embodiment of the present disclosure may include the following steps.

In step S401, the maximum value of the backlight signal values of the adjacent backlight partitions of the backlight partition is acquired.

For example, for the current backlight partition $SB_m$, the maximum value $L_{MAX}$ of the backlight signal values of 8 or 10 adjacent backlight partitions of the current backlight partition $SB_m$ is obtained.

In step S402, the difference value between the maximum value $L_{MAX}$ and the backlight signal value $L_m$ is compared with the backlight jump value $L_{MAX}$.

$(L_{MAX}-L_m)$ is compared with the backlight jump value $L_{STEP}$ of the backlight partition $SB_m$ calculated in step S220.

In step S403, if the difference value $(L_{MAX}-L_m)$ between the maximum value $L_{MAX}$ and the backlight signal value $L_m$ of the backlight partition is greater than the backlight jump value $L_{STEP}$, the adjusted backlight signal value $L_{(m_adj)}$ of the backlight partition is made equal to the difference value $(L_{MAX}-L_{STEP})$ between the maximum value $L_{MAX}$ and the backlight jump value.

In step S404, if the difference value between the maximum value $L_{MAX}$ and the backlight signal value $L_m$ of the backlight partition $(L_{MAX}-L_m)$ is less than or equal to the backlight jump value $L_{STEP}$, the adjusted backlight signal value $L_{(m_adj)}$ of the backlight partition is made equal to the backlight signal value $L_m$ of the backlight partition.

By comparing the backlight signal value of the current backlight partition with the maximum value of the backlight signal values in the adjacent backlight partitions, if the difference value between the two is greater than the backlight jump value, the backlight signal value of the current backlight partition is adjusted so that the adjusted backlight signal value of the current backlight partition is equal to the difference value between the maximum value and the backlight jump value. Otherwise, the backlight signal value of the current backlight partition remains unchanged, that is, the adjusted backlight signal value of the current backlight partition is equal to the backlight signal value determined in step S210, so that the backlight change magnitude between the backlight partition and the adjacent backlight partitions in the display image is controlled within a range that is not easily detectable by the human eyes.

Next, in step S240, the adjusted backlight signal value is used to drive the backlight module to emit light.

It should be noted that the adjusted backlight signal value of each backlight partition obtained in step S230 is substantially in the form of a grayscale value of, for example, 0 to 255. The adjusted backlight signal values may be converted into corresponding driving currents, and the corresponding driving currents may be applied to the LED light sources in the backlight partitions $SB_1$, $SB_2$, $SB_3$, . . . , $SB_M$, respectively, to drive the LED light sources to emit light of corresponding brightness as backlight of the display panel.

Figure 5A:
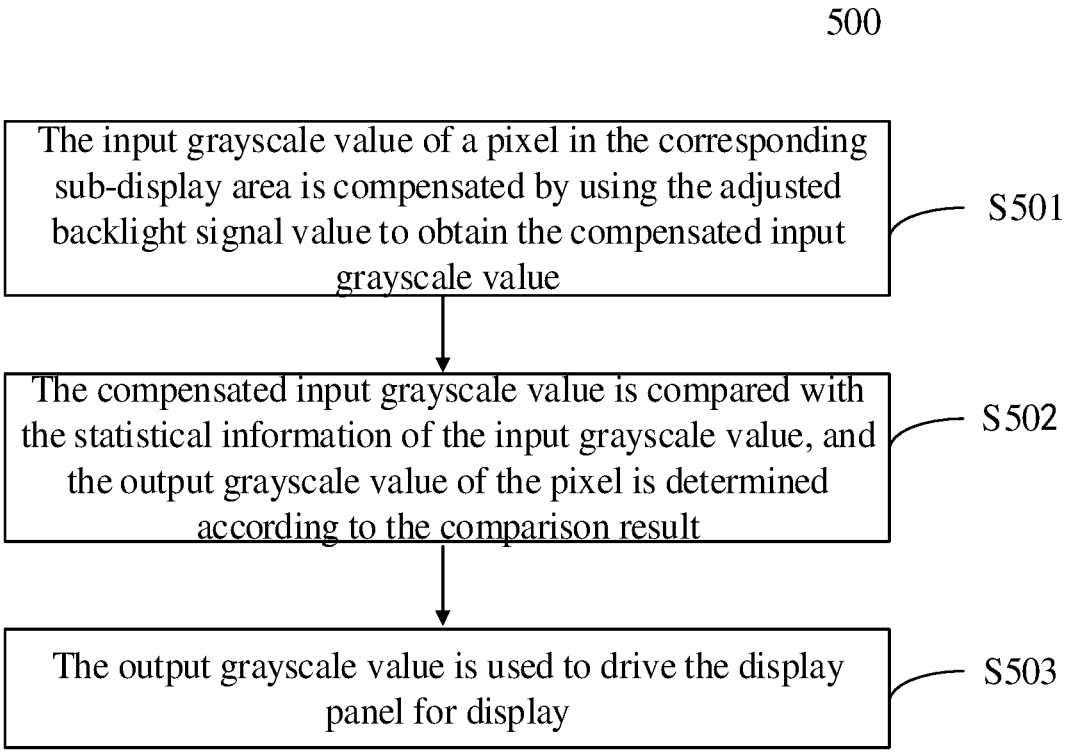
FIG. 5A shows an exemplary flowchart of a display image processing method according to an embodiment of the present disclosure.
Figure 5B:
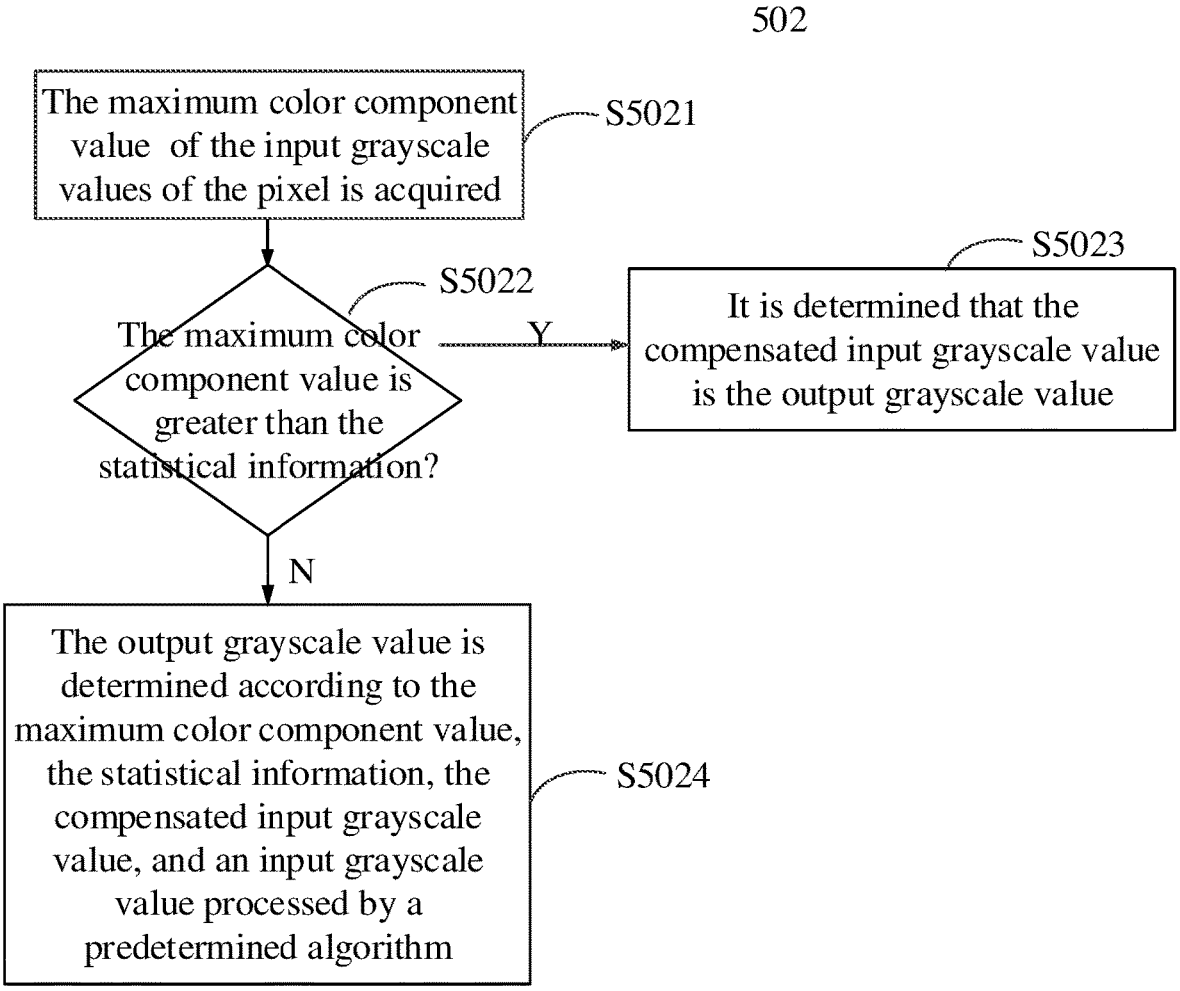
FIG. 5B shows an example flowchart of determining the output grayscale value of a pixel according to an embodiment of the present disclosure.

After obtaining the adjusted backlight signal value of each backlight partition, the method for driving according to an embodiment of the present disclosure may further include performing display image processing on the image to be displayed according to the adjusted backlight signal value, to increase the contrast of the image to be displayed. FIG. 5A shows an exemplary flowchart of a display image processing method provided according to an embodiment of the present disclosure, and FIG. 5B shows an exemplary flowchart of determining the output grayscale values of pixels according to an embodiment of the present disclosure. Next, a display image processing method according to an embodiment of the present disclosure will be described in detail with reference to FIGS. 5A and 5B.

As shown in FIG. 5A, the display image processing method 500 may include the following steps.

In step S501, the input grayscale value of a pixel in the corresponding sub-display area is compensated by using the adjusted backlight signal value to obtain the compensated input grayscale value.

In step S502, the compensated input grayscale value is compared with the statistical information of the input grayscale value of the pixel in the corresponding sub-display area, and an output grayscale value of the pixel is determined according to the comparison result.

In step S503, the determined output grayscale value of the pixel is used to drive the display panel for display.

In step S501, the adjusted backlight signal value $L_{(m_adj)}$ and the predetermined backlight diffusion function H may be used to compensate the input grayscale value of the pixel to obtain the compensated input grayscale value. Step S501 may include two parts: obtaining the actual backlight value and performing compensation.

According to an embodiment of the present disclosure, a certain pixel p in the sub-display area $SA_m$ corresponding to the backlight partition $SB_m$ will be described as an example below.

As mentioned above, the light emitted by the LED light source may cause light diffusion and other phenomena. Therefore, the backlights emitted by the LED light sources located at different positions in the backlight module all affect the actual backlight value of the pixel p. For example, the closer the pixel p is to a certain LED light source, the greater the influence of the brightness of the LED light source on the actual backlight value of the pixel p. Therefore, by integrating the coupling of the brightness of the backlight emitted by each LED light source at different positions in the backlight module on the pixel p, the actual backlight value of the pixel may be obtained. At the same time, the influence of the backlight emitted by the LED light source outside the backlight partition SBi on the pixel p should be minimized. According to an embodiment of the present disclosure, the actual backlight value of the pixel p is calculated by using the predetermined diffusion function H. For example, the following equation (5) may be used to obtain the actual backlight value of the pixel p.

$$BLU_{psf_p}=f(H,L_{adj}') \quad \text{equation (5)}$$

Where H is the predetermined diffusion function, and $L_k'$ is the adjusted backlight signal values set of the backlight partition among the acquired adjusted backlight value $L_{1_adj}$, $L_{2_adj}$, . . . , $L_{M_adj}$, which is considered to have an impact on the brightness of the pixels in the sub-display area $SA_m$, f represents the functional relationship between $BLU_{psf_p}$ and H and $L_{adj}'$.

Those skilled in the art may understand that H substantially represents the diffusion weight of each backlight partition (or backlight source) to the pixel p, and is related to the distance from the pixel p to each backlight partition. According to an embodiment of the present disclosure, the acquired adjusted backlight signal values of the plurality of the backlight partitions are diffused to each pixel in the corresponding sub-display area through the predetermined diffusion function H, thereby obtaining the actual backlight value of each pixel. According to an embodiment of the present disclosure, the function $f$ may include a convolution operation. In order to improve the accuracy of the processing, the function $f$ may also include normalization, data interpolation, and fitting, etc., and the actual backlight value for each pixel is obtained from the curve obtained by the fitting. Those skilled in the art may understand that various methods may be used to perform backlight diffusion to obtain the actual backlight value of each pixel, and the embodiments of the present disclosure are not limited to the above examples.

Next, in step S501, the input grayscale value of the pixel is compensated according to the actual backlight value of the pixel and the input grayscale value of the image to be displayed. As the display brightness of each pixel on the display panel at a certain moment is not only related to the actual backlight value of the pixel at that moment, but also related to the display data of the pixel (that is, the display grayscale value, which determines the transmittance), it is necessary to compensate the display data of the pixel (that is, the input grayscale value of the pixel) to obtain the output grayscale value, so that the display panel achieves ideal display brightness. For example, in order to achieve an ideal display effect, the actual backlight value $BLU_{psf_p}$ of each pixel in the backlight partition is obtained according to equation (5), and the transmittance of each pixel is calculated. After obtaining the transmittance, the compensated input grayscale value $V_{compen_p}$ of each pixel is calculated according to equation (6) to realize the display compensation of the display data of the display screen.

For example, the compensated input grayscale value $V_{compen_p}$ of the pixel p may be calculated by the following equation (6).

$$V_{compen_p}=BLU_{psf_p}\times\eta_p \quad \text{equation (6)}$$

Where $V_{compen_p}$ represents the output grayscale value of the pixel p, $BLU_{psf_p}$ represents the actual backlight value of the pixel p, and $\eta_p$ represents the transmittance of the pixel p.

In an example, the transmittance $\eta_p$ may be expressed as:

$$\eta_p=\left(\frac{v_{input_p}}{v_{max}}\right)^{\gamma}\times\eta_{max} \quad \text{equation (7)}$$

Where $V_{input_p}$ represents the input grayscale value of pixel p. $V_{max}$ represents the highest backlight value, such as 255. $\gamma$ is a predetermined constant, which may be related to the gamma value of the display device, for example, $\gamma=2.2$. $\eta_{max}$ is the transmittance corresponding to the highest backlight value. The term "highest backlight value" may refer to the grayscale value corresponding to a LED light source driven by a maximum rated current. In the case of a given backlight module, the "highest backlight value" is usually a constant. For example, when the grayscale value is represented by 8 bytes, the highest backlight value is 255. Of course, when the grayscale value is represented by 10 bytes, the highest backlight value is 1023. Those skilled in the art may understand that, in the case of a given display panel and a given backlight module, $V_{max}$, $\gamma$, and $\eta_{max}$ are all constants.

Next, in step S502, the compensated input grayscale value is compared with the statistical information of the input grayscale value of the pixel in the sub-display area, and the output grayscale value of the pixel is determined according to the comparison result.

As shown in FIG. 5B, an exemplary method for determining the output grayscale value of a pixel according to an embodiment of the present disclosure may include the following steps.

In step S5021, the maximum color component value $V_{p_max}$ in the input grayscale values of the pixel p is acquired.

In step S5022, the maximum color component value $V_{p_max}$ is compared with the statistical information $S_m$ of the input grayscale value of the pixel in the sub-display area.

In step S5023, if the maximum color component value $V_{p_max}$ is greater than the statistical information $S_m$, it is determined that the compensated input grayscale value $V_{compen_p}$ is the output grayscale value $V_{output_p}$ of the pixel p.

In step S5024, if the maximum color component value $V_{p_max}$ is less than or equal to the statistical information $S_m$, the output grayscale value $V_{output_p}$ of the pixel is determined according to the maximum color component value $V_{p_max}$, the statistical information $S_m$, the compensated input grayscale value $V_{compen_p}$, and an input grayscale value $V_{hazeremove_p}$ processed by a predetermined algorithm.

For example, the statistical information $S_m$ of the input grayscale value of the pixel in the sub-display area may be a cumulative distribution function value of the input grayscale value of the pixel in the sub-display area $SA_m$. For example, if CDF is 0.80, $S_m=L_{0.8}$. According to the histogram statistics of the sub-display area $SA_m$, the input grayscale values of 80% of the pixels are lower than the input grayscale value X', $S_m=L_{0.8}=X$. Of course, those skilled in the art may understand that the statistical information of the input grayscale values of the pixels in the sub-display area, such as the average value, the cumulative distribution function value of other CDF values, etc., may be used as the statistical information $S_m$.

Next, the maximum color component value $V_{p_max}$ is compared with the statistical information $S_m$ of the input grayscale value of the pixel in the sub-display area. If the maximum color component value $V_{p_max}$ is greater than the statistical information $S_m$, it is determined that the compensated input grayscale value $V_{compen_p}$ is the output grayscale value $V_{output_p}$ of the pixel p. That is, $V_{output_p}=V_{compen_p}$.

Otherwise, if the maximum color component value $V_{p_max}$ is less than or equal to the statistical information $S_m$, the output grayscale value $V_{output_p}$ of the pixel p is determined according to the maximum color component value $V_{p_max}$, the statistical information $S_m$, the compensated input grayscale value $V_{compen_p}$, and the input grayscale value $V_{hazeremove_p}$ processed by a predetermined algorithm. For example, the output grayscale value $V_{output_p}$ of the pixel p may be determined according to the following equation (8).

$$V_{output_p} = \frac{(S_m - V_{p_max}) \times V_{hazeremove_p}}{255} + \frac{V_{p_max} \times V_{compen_p}}{255} \quad \text{equation (8)}$$

In an example, the predetermined algorithm may be Haze Removal. Those skilled in the art may understand that the Haze Removal may calculate the high-contrast image after hazing according to the model $I(x)=J(x)\times t(x)+A\times(1-t(x))$, where I (X) is the image to be hazed, J(x) is the haze-free image to be restored, that is, the processed image, A represents the global atmospheric light component, which is usually a constant, and t(x) is the transmittance. Of course, other image processing methods that provide image contrast may also be used to process the input grayscale value of the image to be displayed.

According to the technical solution of the embodiments of the present disclosure, the darker pixels in the image to be displayed, for example, the image processing algorithm using the Haze Removal accounts for a larger proportion; the darker pixels in the image to be displayed, are as consistent as the compensation results in step S501.

After that, in step S503, the output grayscale value $V_{output_p}$ of the determined pixel is used to drive the display panel for display.

The display screen after processing by the image processing method shown in FIGS. 5A and 5B combines the adjustments of the backlight signal value of the backlight area, so as to achieve brighter display areas and darker display areas, and the details of the bright and dark areas are not lost. At the same time, the details of the dark display area are enhanced and the overall visual effect is improved.

In addition, those skilled in the art may understand that, instead of performing the display image processing described with reference to FIGS. 5A and 5B, the input grayscale values of pixels in the image to be displayed may be used to directly drive the display panel to display the image.

It should be noted that in each embodiment of the present disclosure, the flow of the method for driving may include more or fewer operations, and these operations may be executed sequentially or in parallel. Although the flow of the display image processing method described above includes multiple operations appearing in a specific order, it should be clearly understood that the order of the multiple operations is not limited. The trend method described above may be executed once or multiple times according to predetermined conditions.

Figure 6A:
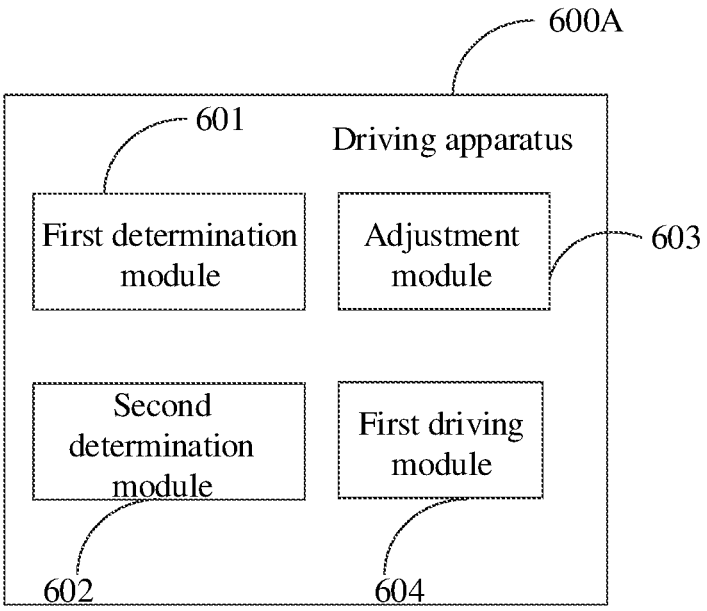
FIG. 6A shows a schematic structural diagram of a driving apparatus according to an embodiment of the present disclosure.

FIG. 6A shows a schematic structural diagram of a driving apparatus according to an embodiment of the present disclosure. As shown in FIG. 6A, the driving apparatus 600A according to an embodiment of the present disclosure may include: a first determination module 601 configured to determine the backlight signal values of the plurality of backlight partitions according to the input grayscale values of pixels in the image to be displayed; a second determination module 602 configured to determine the backlight jump value of each of the plurality of backlight partitions according to the backlight signal values of the plurality of backlight partitions; an adjustment module 603 configured to adjust the backlight signal values of the plurality of backlight partitions according to the backlight jump values to obtain the adjusted backlight signal values; and a first driving module 604 configured to drive the backlight module to emit light by using the adjusted backlight signal values. Where the second determination module 602 is further configured to: acquire a calculation model by fitting according to the backlight signal values of the backlight partitions, the backlight interference values of the plurality of adjacent backlight partitions of the backlight partition, and the average value of the input pixel values of each color component in the sub-display area corresponding to the backlight partition; and use the calculation model to calculate the backlight jump values of the backlight partitions.

Those skilled in the art may understand that the functional modules in the driving apparatus 600A according to an embodiment of the present disclosure may be used to implement various functions of the exemplary driving method according to an embodiment of the present disclosure, such as the driving method described above with reference to FIGS. 1 to 5B, which will not be repeated here for brevity.

Figure 6B:
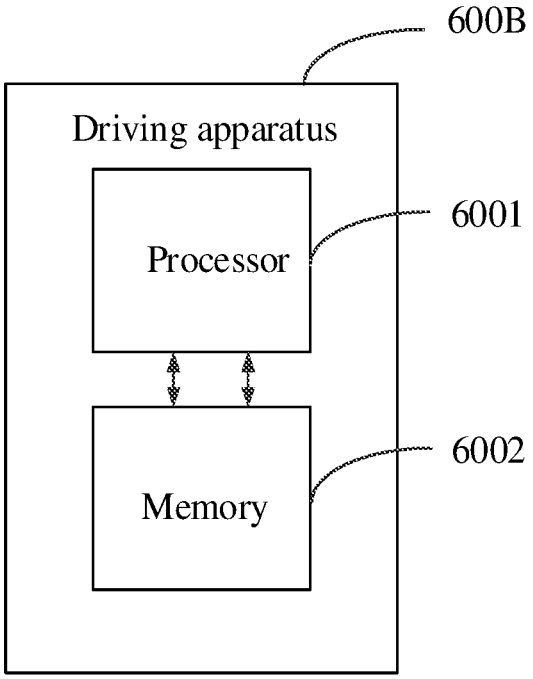
FIG. 6B shows a schematic structural diagram of a driving apparatus according to another embodiment of the present disclosure.

FIG. 6B shows a schematic structural diagram of a driving apparatus according to another embodiment of the present disclosure. As shown in FIG. 6B, the driving apparatus 600B according to an embodiment of the present disclosure may include: at least one processor 6001; and a memory 6002. The memory 6002 may store instructions. At least one processor 6001 executes instructions stored in the memory 6002 to implement the driving method according to an embodiment of the present disclosure.

Those skilled in the art may understand that by executing the instructions stored in the memory 6002 by the processor 6001, the driving apparatus 600B according to an embodiment of the present disclosure may implement various functions of the exemplary driving method according to an embodiment of the present disclosure, for example, the driving method described above with reference to FIGS. 1 to 5B, which will not be repeated here for brevity.

In addition, the backlight signal value of each backlight partition, the adjusted backlight signal value, and other parameters generated in the display image process obtained in the above multiple steps may be stored in the memory 6002, and may be called by the processor 6001 when needed.

Figure 7:
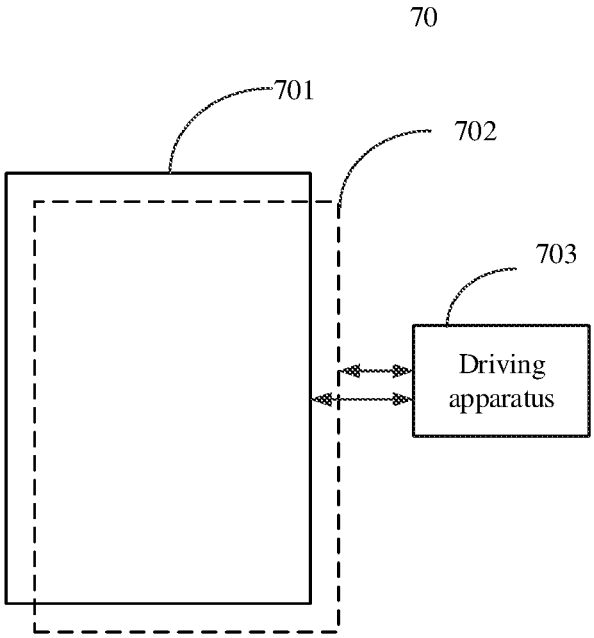
FIG. 7 shows a schematic structural diagram of a display device according to an embodiment of the present disclosure.

FIG. 7 shows a schematic structural diagram of a display device according to an embodiment of the present disclosure. As shown in FIG. 7, the display device 70 according to an embodiment of the present disclosure may include: a display panel 710, a backlight module 720, and a driving apparatus 730. The driving apparatus 730 may be, for example, the driving apparatus in an embodiment shown in FIG. 6A, or may be, for example, the driving apparatus in an embodiment shown in FIG. 6B.

Those skilled in the art may understand that the display device 70 according to the embodiments of the present disclosure may be any product or component having a display function, such as a virtual reality device, an electronic paper, a mobile phone, a tablet computer, a television, a monitor, a notebook computer, a digital photo frame, a navigator, etc.

It should be illustrated that, functions described herein as being implemented by pure hardware, pure software, and/or firmware may also be implemented by means of dedicated hardware, a combination of general-purpose hardware and software, etc. For example, functions described as being implemented by dedicated hardware (for example, Field Programmable Gate Array (FPGA), Application Specific Integrated Circuit (ASIC), etc.) may be implemented by a combination of general purpose hardware (for example, Central Processing Unit (CPU), or Digital Signal Processor (DSP)) and software, and vice versa.

The present disclosure has been described in conjunction with the embodiments. It should be understood that those skilled in the art may make various other changes, substitutions and additions without departing from the spirit and scope of the embodiments of the present disclosure. Therefore, the scope of the embodiments of the present disclosure is not limited to the above specific embodiments, but should be defined by the appended claims.

What is claimed is:

1. A method for driving a display device comprising a backlight module, the backlight module comprises a plurality of backlight partitions, and the method comprising:

determining backlight signal values of the plurality of backlight partitions according to input grayscale values of pixels in an image to be displayed;

determining a backlight jump value of each of the plurality of backlight partitions according to the backlight signal values of the plurality of backlight partitions;

adjusting the backlight signal values of the plurality of backlight partitions according to the backlight jump values to obtain adjusted backlight signal values; and driving the backlight module to emit light using the adjusted backlight signal values;

wherein determining a backlight jump value of each of the plurality of backlight partitions according to the backlight signal values of the plurality of backlight partitions comprises:

acquiring a calculation model by fitting according to the backlight signal value of the backlight partition, a backlight interference value of a plurality of adjacent backlight partitions of the backlight partition, and an average value of input pixel values of each color component in a sub-display area corresponding to the backlight partition; and calculating the backlight jump value of the backlight partition using the calculation model; and wherein determining backlight signal values of the plurality of backlight partitions in the backlight module comprises, for each of the plurality of backlight partitions:

calculating an average value of the input grayscale values of pixels and a cumulative distribution function value in the sub-display area corresponding to the backlight partition; and determining the backlight signal value of the backlight partition according to the average value and the cumulative distribution function value, comprising determining the backlight signal value $L_m$ of the backlight partition by using the following equation:

$$\left\{L_m = L_{avg} + k \times \left(L_{dif} + \frac{L_{dif}^2}{255}\right)\right.$$

wherein $L_{avg}$ is an average value of the input grayscale values in the sub-display area corresponding to the backlight partition, $L_{dif}=L_{cdf}-L_{avg}$, and $L_{cdf}$ is a cumulative distribution function value of the input grayscale value of the pixel in the corresponding sub-display area, $$k = 0.5 - \frac{L_{dif}}{255} * 0.5.$$

2. The method according to claim 1, wherein the calculation model is expressed as:

$$L_{STEP}=a_1+a_2\times L_m+a_3\times L_m^2+a_4\times L_m^3+a_5\times L_{ROUND}+a_6\times L_{ROUND}^2+a_7\times L_{ROUND}^3+a_8\times L_m\times L_{ROUND}+a_9\times R_{avg}+a_{10}\times R_{avg}^2+a_{11}\times R_{avg}^3+a_{12}\times G_{avg}+a_{13}\times G_{avg}^2+a_{14}\times G_{avg}^3+a_{15}\times B_{avg}+a_{16}\times B_{avg}^2+a_{17}\times B_{avg}^3,$$

wherein $L_{STEP}$ is the backlight jump value of the backlight partition, $L_m$ is the backlight signal value of the backlight partition, $L_{ROUND}$ is the backlight interference value of the plurality of adjacent backlight partitions of the backlight partition, and $R_{avg}$ is an average value of input pixel values of a red color component in the sub-display area corresponding to the backlight partition, $G_{avg}$ is an average value of input pixel values of a green color component in the sub-display area corresponding to the backlight partition, and $B_{avg}$ is an average value of input pixel values of a blue color component in the sub-display area corresponding to the backlight partition, $a_1$ to $a_{17}$ are coefficients of the calculation model obtained by performing fitting using the calculation model.

3. The method according to claim 1, wherein the adjusting the backlight signal values of the plurality of backlight partitions according to the backlight jump values comprises:

for each of the plurality of backlight partitions:

acquiring a maximum value of the backlight signal values of at least one adjacent backlight partition of the backlight partition;

comparing a difference value between the maximum value and the backlight signal value with the backlight jump value;

if the difference value between the maximum value and the backlight signal value of the backlight partition is greater than the backlight jump value, then the adjusted backlight signal value of the backlight partition is equal to an difference value between the maximum value and the backlight jump value; and if the difference value between the maximum value and the backlight signal value of the backlight partition is less than or equal to the backlight jump value, then the adjusted backlight signal value of the backlight partition is equal to the backlight signal value of the backlight partition.

4. The method according to claim 1, wherein the display device further comprises a display panel, and the method further comprises:

compensating the input grayscale value of a pixel in the corresponding sub-display area by using the adjusted backlight signal value to obtain a compensated input grayscale value;

comparing the compensated input grayscale value with statistical information of the input grayscale value of the pixel in the corresponding sub-display area, and determining an output grayscale value of the pixel according to a comparison result; and driving the display panel for display by using the determined output grayscale value of the pixel.

5. The method according to claim 4, wherein the comparing the compensated input grayscale value with statistical information of the input grayscale value of the pixel in the corresponding sub-display area, and determining an output grayscale value of the pixel according to a comparison result comprises:

acquiring a maximum color component value of the compensated input grayscale value;

comparing the maximum color component value with the statistical information;

determining that the compensated input grayscale value is the output grayscale value of the pixel, in response to the maximum color component value being greater than the statistical information; and determining the output grayscale value of the pixel according to the maximum color component value, the statistical information, the compensated input grayscale value, and an input gray scale value processed by a predetermined algorithm, in response to the maximum color component value being less than or equal to the statistical information.

6. The method according to claim 5, wherein if the maximum color component value is less than or equal to the statistical information, the output grayscale value $V_{output_p}$ of the pixel p is determined according to the following equation:

$$V_{output_p} = \frac{(S_m - V_{p_max}) \times V_{hazeremove_p}}{255} + \frac{V_{p_max} \times V_{compen_p}}{255}$$

wherein $V_{p_max}$ is the maximum color component value, $S_m$ is the statistical information, $V_{compen_p}$ is the compensated input grayscale value, and $V_{hazeremove_p}$ is the input grayscale value processed by the predetermined algorithm.

7. The method according to claim 5, wherein the predetermined algorithm comprises a Haze Removal.

8. A driving apparatus, comprising:

a memory configured to store instructions;

at least one processor which executes the instructions stored in the memory to implement the method according to claim 1.

9. A display device, comprising:

a display panel comprising a plurality of sub-display areas;

a backlight module comprising a plurality of backlight partitions; and the driving apparatus according to claim 8.

10. A non-transitory computer-readable storage medium having stored thereon instructions that are configured to, when executed by at least one processor, implement the method according to claim 1.

11. An apparatus for driving a display device, the display device comprises a backlight module comprising a plurality of backlight partitions, and the apparatus comprises:

a first determination module configured to determine backlight signal values of the plurality of backlight partitions according to input grayscale values of pixels in an image to be displayed;

a second determination module configured to determine a backlight jump value of each of the plurality of backlight partitions according to the backlight signal values of the plurality of backlight partitions;

an adjustment module configured to adjust the backlight signal values of the plurality of backlight partitions according to the backlight jump values to obtain adjusted backlight signal values; and a first driving module configured to drive the backlight module to emit light by using the adjusted backlight signal values;

wherein the second determination module is further configured to:

acquire a calculation model by fitting according to the backlight signal values of the backlight partitions, a backlight interference value of the plurality of adjacent backlight partitions to each backlight partition, and an average value of input pixel values of each color component in a sub-display area corresponding to each backlight partition; and calculate the backlight jump values of the backlight partitions by using the calculation model, and wherein the first determination module is further configured to: for each of the plurality of backlight partitions, calculate an average value of the input grayscale values of pixels and a cumulative distribution function value in the sub-display area corresponding to the backlight partition; and determine the backlight signal value of the backlight partition according to the average value and the cumulative distribution function value, comprising determine the backlight signal value $L_m$ of the backlight partition by using the following equation:

$$\left\{ L_m = L_{avg} + k \times \left( L_{dif} + \frac{L_{dif}^2}{255} \right) \right.$$

wherein $L_{avg}$ is an average value of the input grayscale values in the sub-display area corresponding to the backlight partition, $L_{dif}=L_{cdf}-L_{avg}$, and $L_{cdf}$ is a is a cumulative distribution function value of the input grayscale value of the pixel in the corresponding sub-display area, $$k = 0.5 - \frac{L_{dif}}{255} * 0.5.$$

12. The apparatus according to claim 11, wherein the display device further comprises a display panel, and the apparatus further comprises a third determination module configured to acquire a maximum color component value of a compensated input grayscale value; compare the maximum color component value with statistical information; determine that the compensated input grayscale value is an output grayscale value of a pixel, in response to the maximum color component value being greater than the statistical information; and determine the output grayscale value of the pixel according to the maximum color component value, the statistical information, the compensated input grayscale value, and an input gray scale value processed by a predetermined algorithm, in response to the maximum color component value is less than or equal to the statistical information; and a second driving module configured to drive the display panel for display by using the determined output grayscale value of the pixel.

* * * * *